US006415552B1

(12) United States Patent
Khosropour

(10) Patent No.: US 6,415,552 B1
(45) Date of Patent: Jul. 9, 2002

(54) APPLIANCE SYSTEM WITH EXTERIOR ACCESS

(75) Inventor: Mostafa Michael Khosropour, Newton, IA (US)

(73) Assignee: Maytag Corporation, Newton, IA (US)

( * ) Notice: Subject to any disclaimer, the term of this patent is extended or adjusted under 35 U.S.C. 154(b) by 9 days.

(21) Appl. No.: 09/626,148

(22) Filed: Jul. 26, 2000

(51) Int. Cl.[7] ..... F25D 23/10; F25D 23/12; A47G 29/14; A47G 29/20; A47G 29/28

(52) U.S. Cl. ..... 52/27; 62/263; 312/242; 312/286; 312/101; 232/1 R; 232/1 E; 232/41 A; 232/43.4

(58) Field of Search ..... 52/27, 220.8; 232/1 R, 232/1 E, 41 R, 41 A, 43.1, 43.4, 1 A; 312/101, 242, 286, 287; 62/263, 267, 3.6

(56) References Cited

U.S. PATENT DOCUMENTS

| | | | | | |
|---|---|---|---|---|---|
| 492,443 | A | | 2/1893 | Stewart | |
| 908,770 | A | | 1/1909 | Hartman | |
| 1,183,095 | A | * | 5/1916 | Martin et al. | 232/41 A |
| 1,224,766 | A | * | 5/1917 | Martin et al. | 232/41 A |
| 1,469,359 | A | * | 10/1923 | Craw | 232/1 R |
| 1,570,207 | A | * | 10/1926 | Craw | 232/43.4 |
| 1,704,113 | A | * | 3/1929 | Strufe | 62/263 |
| 1,815,855 | A | | 7/1931 | Lauritano | |
| 1,901,509 | A | * | 3/1933 | Hall | 312/286 X |
| 1,935,130 | A | * | 11/1933 | Schauman | 52/29 |
| 2,142,599 | A | * | 1/1939 | Binder | 232/41 R |
| 2,404,851 | A | * | 7/1946 | Knowles et al. | 312/286 |
| 2,530,543 | A | | 1/1950 | Schneeman | |
| 2,579,379 | A | | 12/1951 | Fritsche | |
| 2,629,231 | A | * | 2/1953 | Malek | 232/41 R |
| 2,781,965 | A | * | 2/1957 | Dembs | 232/43.4 |
| 2,915,960 | A | * | 12/1959 | McClellan, Jr. | 312/242 X |
| 3,078,682 | A | | 2/1963 | Gould | |
| 3,708,997 | A | | 1/1973 | McLaughlin | |
| 4,024,729 | A | | 5/1977 | Abate, Sr. et al. | |
| RE31,409 | E | | 10/1983 | Crist | |
| 5,774,053 | A | | 6/1998 | Porter | |
| 5,979,750 | A | | 11/1999 | Kindell | |
| 6,079,216 | A | | 6/2000 | De Marsillac Plunkett et al. | |
| 6,220,049 | B1 | * | 4/2001 | Lajeunesse | 312/287 X |

* cited by examiner

*Primary Examiner*—Laura A. Callo
(74) *Attorney, Agent, or Firm*—Diederiks &Whitelaw, PLC

(57) ABSTRACT

A building includes an exterior wall provided with a door which can be opened to expose a plurality of compartments for receiving a wide range of deliverable products. The compartments are defined as sections of one or more appliances. Preferably, the exterior door can be used to expose both fresh food and freezer compartments of a refrigerator, as well as one or more compartments of an oven unit. Each of the compartments is also accessible from an interior of the building through an associated inner door. The inner and outer doors can be electronically latched and are linked together such that at least the exterior door is prevented from being opened whenever a specified interior door is open.

28 Claims, 4 Drawing Sheets

APPLIANCE SYSTEM WITH EXTERIOR ACCESS

BACKGROUND OF THE INVENTION

1. Field of the Invention

The present invention pertains to the art of appliances and, more particularly, to an appliance system provided in a building wherein access to various compartments of the system is accommodated from both inside and outside of the building.

2. Discussion of the Prior Art

In past years, perhaps more prevalently in more rural settings, it was not uncommon to find certain perishable food items being delivered directly to a home or business by food suppliers. For example, it was not uncommon to have various dairy products directly delivered to a residence and placed in an insulated, outside box or the like. Mainly due to the convenience, the direct delivery of food items to homes and businesses is now becoming even more popular. The increasing number of food delivery companies particularly evidences this popularity.

For instance, many companies employ refrigerated trucks to store a wide range of food products for sale and immediate delivery directly to homeowners. That is, a salesman personally greets the consumer and a direct food-for-money exchange is made. In addition, it is known for homeowners to contract with a food delivery service which supplies preselected food items periodically. In addition to these conventional food service companies, certain supermarket stores are initiating projects wherein fresh food grocery orders can be taken by phone or over the internet, with the groceries being delivered directly to the customer at a specified location. This service can be accomplished with or without the customer actually being present at the time of delivery.

With this increase in popularity in food delivery services comes a heightened awareness of the possible dangers, particularly security risks. This potential problem is of particular concern in situations wherein delivery personnel must be granted unattended access to the home or business because perishable food items need to be stored in a controlled environment, i.e., in a refrigerator. To address this concern, it has heretofore been proposed to expose a fresh food refrigerator compartment to the exterior of a house or other building wherein the delivery personnel can simply stock the refrigerator with fresh food items which can be later consumed by the customer. In some proposed arrangements, the refrigerator is positioned at an exterior wall of a building such that the fresh food compartment can be accessed from both the interior and exterior of the building. With this arrangement, the consumer does not need to transfer the products inside after a delivery is made. However, such an arrangement again raises concerns about access to within the building by the delivery personnel.

Despite the increased awareness of such delivery systems, their popularity is still fairly low such that there exists a need in the art for an improved system which will not only address security concerns, but which is extremely versatile in the quantity and type of deliveries that can be received. The known arrangements which simply provide an exteriorly exposed structure for certain deliveries adds some level of convenience to the consumer, but the desire would be to provide a secure, combined exterior/interior arrangement which enables, not only the safe delivery of refrigerated fresh foods, but also products which need to be frozen or heated, as well as products which do not require any specific environmentally controlled storage zone.

SUMMARY OF THE INVENTION

The present invention is directed to an appliance access system for a building including an exterior wall provided with a door which can be opened to expose a plurality of environmentally varying storage zones for receiving a wide range of deliverable products. In a preferred embodiment of the invention, the system defines a plurality of compartments, which can be either heated or cooled. In the most preferred form of the invention, the exterior door can be opened to expose a refrigerator having both fresh food and freezer compartments, an oven having a heating compartment or cavity, and even a storage zone for non-perishable items. Each compartment/zone preferably has an associated internal or sub-exterior door which can be appropriately marked for aiding delivery personnel.

Therefore, the invention is concerned with a versatile product storage system combining various known appliance features, either as separate units or integrated devices, to enable a wide range of products to be delivered and stored for later use from outside the building, but which can also be readily accessed from within the building. To this end, it is desired to provide structure linking interior and exterior access doors of the system in a manner which prevents opening of the exterior access door if the interior access door is open. From the outside, opening of the exterior door is controlled by a latching system, preferably electronically controlled, such as through the use of a punch pad. The exterior door is preferably camouflaged due to the construction of the side of the building so that no attention is even drawn to the existence of the door.

With this overall construction, the appliance access system of the invention provides for the safe delivery of a wide range of products, including food items which need to be maintained slightly below room temperature, frozen, heated or otherwise. In addition, delivery is convenient, with a single exterior door providing access to multiple environmentally varying compartments which, in turn, are separately accessible from the interior of the building. In any event, additional objects, features and advantages of the invention will become more readily apparent from the following detailed description of a preferred embodiment thereof when taken in conjunction with the drawings wherein like reference numerals refer to corresponding parts in the several views.

DETAILED DESCRIPTION OF A PREFERRED EMBODIMENT

Figure 1:
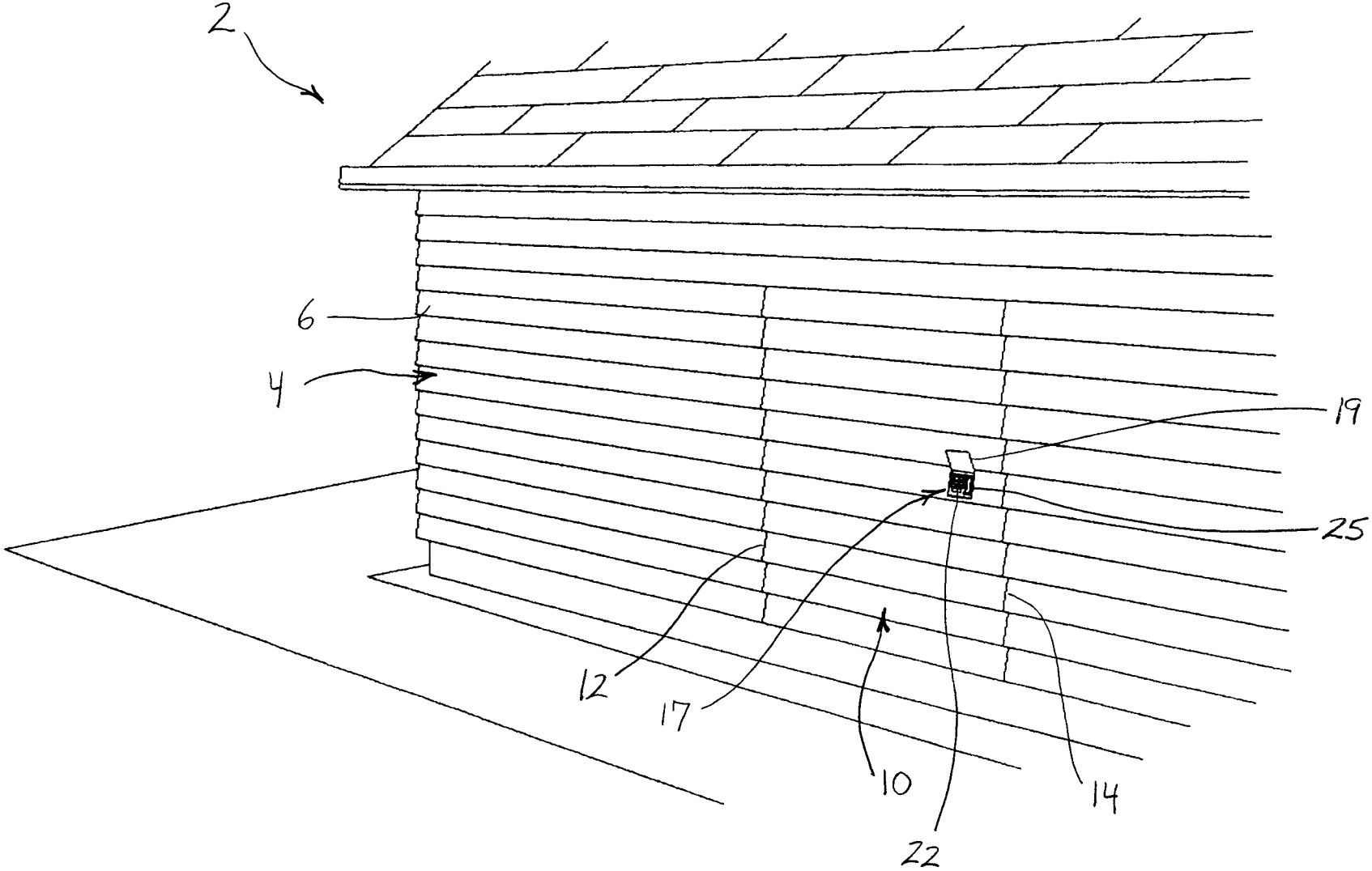
FIG. 1 is a perspective view of a side of a building provided with an enlarged access door, with a cover for an electronic punch pad being opened.

With initial reference to FIG. 1, a building incorporating the appliance access system of the invention is generally indicated at 2. Building 2 includes an exterior wall 4 upon which is provided siding 6. At this point, it should be noted that siding 6 can take various forms in accordance with the invention, including aluminum, vinyl, wood and the like. More importantly, exterior wall 4 incorporates a door 10 having an associated hinge side 12 and opening side 14. Door 10 has mounted therein a punch pad 17 that is preferably located beneath a pivoting flap 19 which, when closed, simulates an extension of siding 6. In the embodiment shown, punch pad 17 is preferably electronic and includes an array of numbers as generally indicated at 22. Also beneath pivoting flap 19 is preferably provided a handle 25 for use in opening door 10 once door 10 is unlatched through the use of punch pad 17 in the manner which will be described more fully below.

Figure 2:
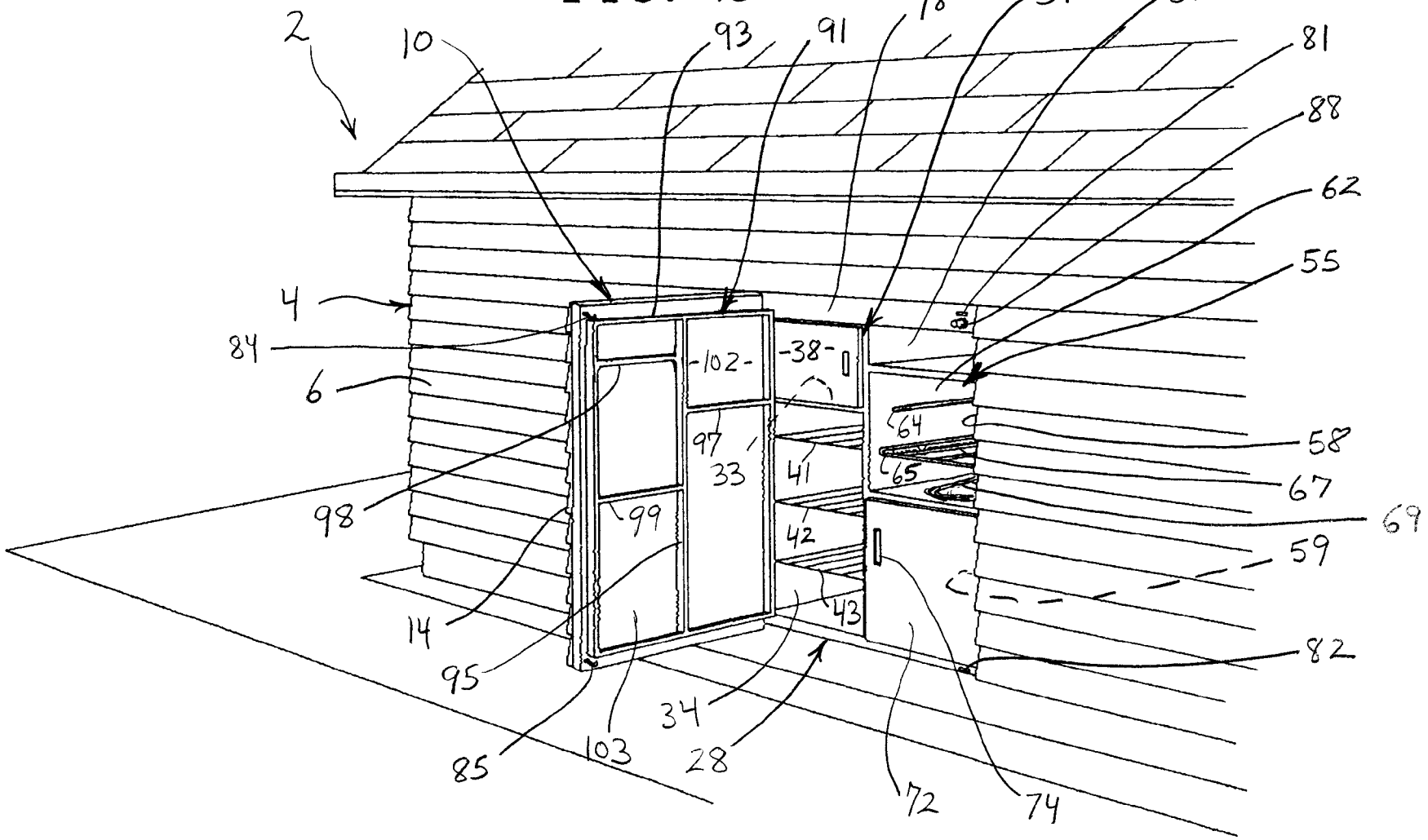
FIG. 2 is a perspective view of the side of the building in FIG. 1 with the access door opened, thereby exposing various compartments of an overall appliance system.

When door 10 is opened, an appliance system constructed in accordance with the present invention is generally exposed as represented at 28 in FIG. 2. Appliance system 28 is shown to incorporate a refrigerator unit 31 including an upper freezer compartment 33 and a lower fresh food compartment 34. A sub-exterior door 38, which is also preferably mounted for pivotal movement about a vertical axis adjacent hinge side 12 of door 10, is provided across freezer compartment 33. Although a similar door could be provided for fresh food compartment 34, it is preferable to have fresh food compartment 34 exposed upon opening of door 10 and to be provided with a plurality of vertically spaced shelves 41–43.

Adjacent refrigerator unit 31 is provided an upper storage zone 51 and a lower oven unit 55. In accordance with the most preferred embodiment of the invention, oven unit 55 includes an upper compartment or cavity 58, as well as a lower compartment or cavity 59. In general, each of the upper and lower compartments 58 and 59 are identically constructed and include top, bottom and side walls, with one side wall (shown at 62) being formed with various vertically spaced and fore-to-aft extending rails 64, 65 upon which can be slidably supported a rack 67 for supporting food items to be heated or maintained warm within oven unit 55. In the most preferred embodiment shown, oven unit 55 constitutes an electric oven such that upper compartment 58 is shown to include a lower electric heating element 69. Although the preferred embodiment for oven unit 55 is electric, other energy sources could be readily utilized in the manner known in the art. In a manner analogous to freezer compartment 33, lower compartment 59 of oven unit 55 is shown to be provided with a sub-exterior door 72 that can be pivoted through the use of recessed handle 74 to actually access lower compartment 59. Of course, a corresponding sub-exterior door could also be provided for upper compartment 58 of oven unit 55.

At this point, it should be pointed out that door 38 is provided in order to enable a more exacting seal around the opening for freezer compartment 33. Although door 38 is optional, the most preferred form of the invention actually incorporates separate sub-exterior doors for each of freezer compartment 33, fresh food compartment 34, upper and lower oven compartments 58 and 59 and storage zone 51, with each of the doors being separately labeled to aid delivery personnel in storing items appropriately. Only doors 38 and 72 are shown for the sake of clarity of the drawings and to enable additional details of the overall appliance system 28 to be illustrated in these figures. In any event, it is an aspect of the present invention to incorporate a refrigerator unit 31 that includes both freezer and fresh food compartments 33 and 34, each of which is exposed upon opening of door 10. With this arrangement, authorized delivery personnel of food items can open door 10 through the use of punch pad 17 in order to stock both fresh and frozen food items in fresh food compartment 34 and freezer compartment 33 respectively. In addition, food items that need to be cooked or simply maintained warm can be placed in upper compartment 58 or lower compartment 59 of oven unit 55. Finally, non-perishable food items which need not be refrigerated or heated can be placed in upper storage zone 51. Therefore, with this arrangement, a wide range of food products, as well as non-food related products, can be delivered to the owners of building 2 by delivery personnel who are provided with the required code for punch pad 17. Essentially, each of the main types of food items delivered to a home can be properly placed in a respective zone of appliance system 28.

As shown, appliance system 28 preferably includes a frame 78 that extends about refrigerator unit 31, upper storage zone 51 and oven unit 55. At upper and lower portions of frame 78, preferably along opening side 14 of door 10, frame 78 is provided with slots 81 and 82 which are adapted to receive hooking elements 84 and 85 attached to door 10. Hooking elements 84 and 85 form part of an overall latching arrangement for door 10. Actually, the type of latching arrangement utilized can greatly vary in accordance with the invention. Most preferably, an electronic, solenoid controlled latching system is utilized as will be discussed more fully below in connection with the arrangement shown in FIG. 4. In any event, in the embodiment shown, hooking elements 84 and 85 extend into slots 81 and 82 upon closing of door 10 and are used to securely lock door 10 closed across appliance system 28 in a manner generally shown in FIG. 1. A switch 88, generally shown to be a push-button type switch, is provided on frame 78 in order to sense the opened/closed state of door 10.

As also shown in FIG. 2, an insulative backing 91 is preferably provided on door 2. Insulative backing 91 includes an outer periphery 93, a generally central, vertical divider 95 and a plurality of horizontal dividers 97–99. In general, outer peripheral portion 93 of insulative backing 91 extends about frame 78 of appliance system 28, vertical divider 95 extends between refrigerator unit 31 and oven unit 55, horizontal divider 97 extends between freezer compartment 33 and fresh food compartment 34, horizontal divider 98 extends laterally between upper storage zone 51 and upper compartment 58 of oven unit 55, and horizontal divider 99 extends between upper and lower compartments 58 and 59 of oven unit 55 when door 10 is closed. Preferably, the structure which defines the outer portions of refrigerator unit 31 and oven unit 55 are highly insulated, particularly given that refrigerator unit 31 is obviously used for cooling food products and oven unit 55 is used for heating food products. Insulative backing 91 simply extends these insulative features, while also being capable of withstanding the range of operating temperatures associated with appliance system 28, particularly if sub-exterior doors, such as doors 38 and 72, are not provided.

The arrangement of outer periphery 93, vertical divider 95 and horizontal dividers 97–99 produce various recessed areas in insulative backing 91, such as recessed areas 102 and 103. In the preferred embodiment shown, door 38 for freezer compartment 33 is adapted to be received in recessed area 102 and door 72 for lower compartment 59 of oven unit 55 is adapted to be received in recessed area 103 when door 10 is closed. As clearly shown in this figure, provisions are made for additional recessed areas which could be used with other sub-exterior doors for fresh food compartment 34, upper storage zone 55 and/or upper compartment 58 of oven unit 55.

Figure 3:
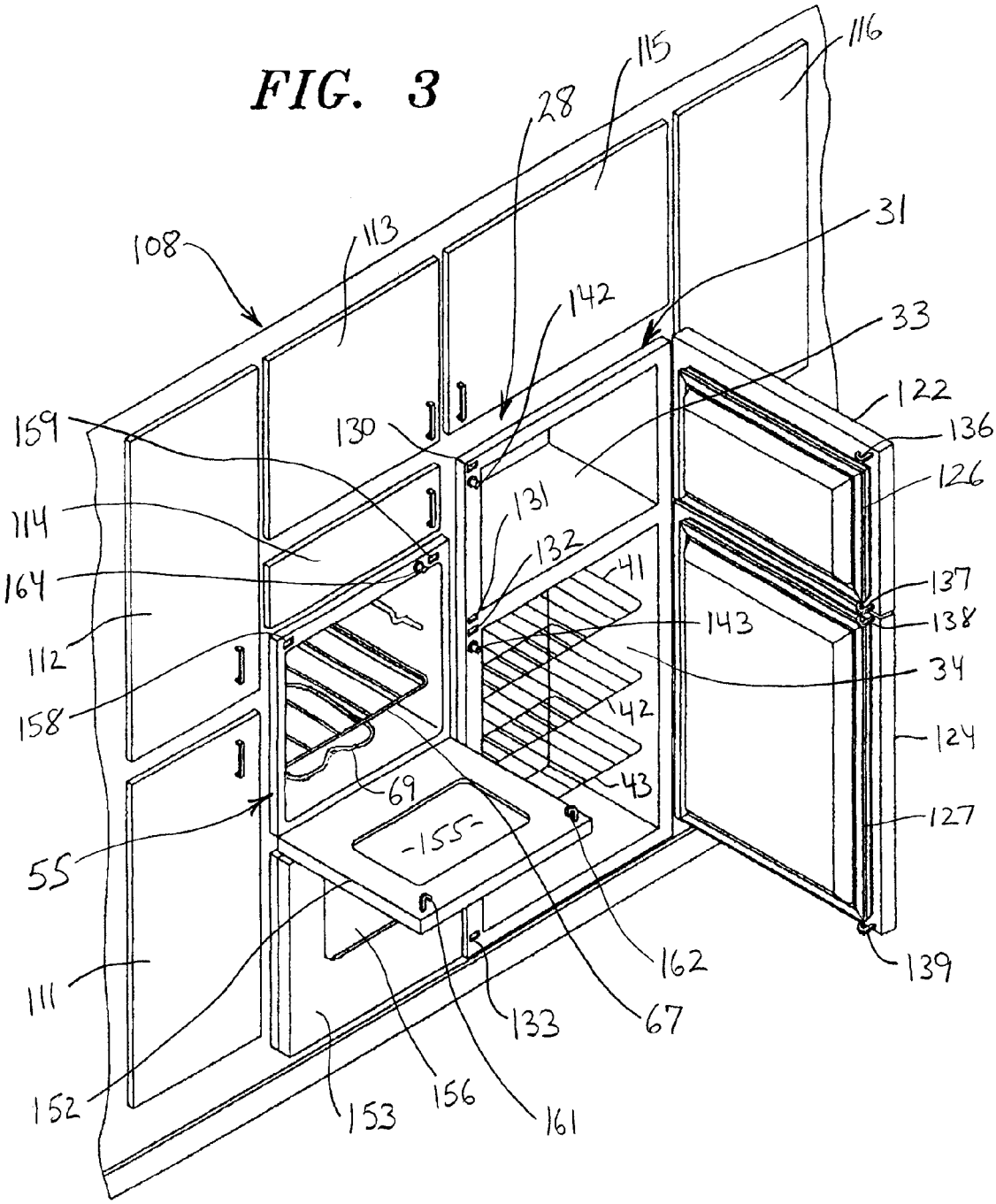
FIG. 3 is an upper perspective view of an interior portion of the building shown in FIGS. 1 and 2.

Opposing exterior wall 4 of building 2 to is an inside portion 108 as shown in FIG. 3. Therefore, in accordance with the invention, appliance system 28 is also exposed at inside portion 108. For the sake of completeness, a plurality of cabinets, having associated doors 111–116, are provided, with cabinet door 114 actually extending across upper storage zone 51. In any event, refrigerator unit 31 is also open to inside portion 108, as well as oven unit 55. In a manner generally known in the art, freezer compartment 33 has an associated freezer door 122 and fresh food compartment 34 has an associated fresh food door 124. Both freezer and fresh food doors 122 and 124 preferably pivot about a generally vertical axis. In the preferred embodiment shown, a top-mount style refrigerator is provided, but it is to be understood that other style refrigerators, including a side-by-side type refrigerator, could also be readily utilized in accordance with the invention. For the sake of simplicity, doors 122 and 124 have not been shown to include shelves, although it is understood that various food item supporting shelves could be provided on both of these doors 122 and 124. In the manner also widely known in the art, doors 122 and 124 include respective peripheral seals 126 and 127 for sealing off freezer and fresh food compartments 33 and 34 respectively.

In accordance with the invention, refrigerator unit 31 also includes latching arrangements for both doors 122 and 124. For exemplary purposes, it has been shown that refrigerator unit 31 includes respective sets of slots 130–133 and corresponding hooking elements 136–139. As will be discussed more fully below, hooking elements 136–139 are utilized in connection with latching doors 122 and 124 in a closed condition whenever exterior door 10 is open. With this arrangement, direct access to within the interior of building 2 is not permitted through door 10. In addition, it is preferable to provide respective switches 142 and 143 for use in signaling the opened/closed state of freezer door 122 and fresh food door 124 respectively.

In a similar manner, oven unit 55 includes an upper door 152 and a lower door 153. As shown, each of these doors 152, 153 includes a respective viewing window 155, 156. Oven unit 55 includes various slots, such as those shown at 158 and 159, for receiving respective hooking elements 161, 162 for upper compartment door 152. With this arrangement, it can be assured that upper oven door 152 is locked whenever door 10 is open. Although not shown, a similar arrangement would also be provided for lower oven door 153. In addition, upper and lower oven doors 152 and 153 would have associated therewith respective switches, such as that indicated at 164 for upper oven door 152, to indicate the opened/closed state thereof.

Figure 4:
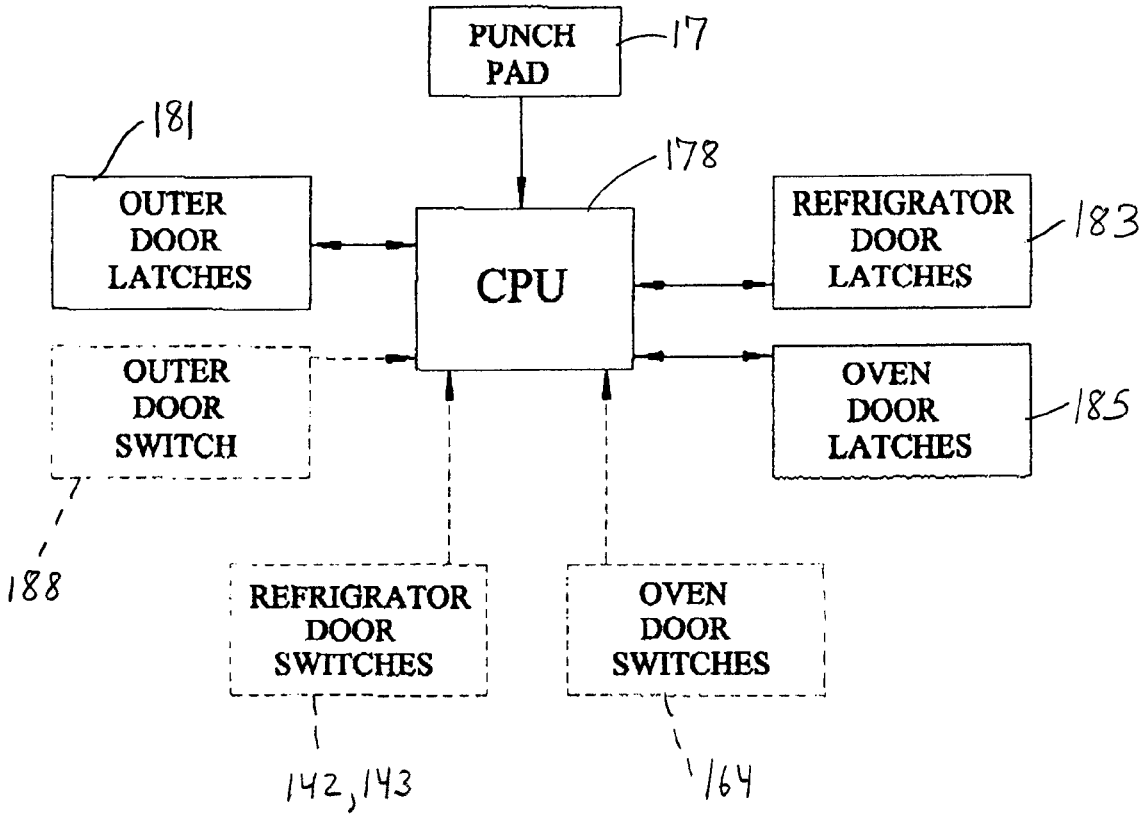
FIG. 4 is a block diagram illustrating a lock control arrangement incorporated in the appliance system of the invention.

As indicated above, it is desired in accordance with the present invention to assure that personnel which are authorized to deliver food and/or other items to appliance system 28 cannot directly enter building 2 through door 10. Most preferably, this feature of the invention is accomplished electronically, through the use of a controller or CPU 178 (see FIG. 4) which is electronically linked to punch pad 17, as well as various door latches. As generally shown in FIG. 4, latches for outer door 10 are located at 181, latches for refrigerator doors 122 and 124 are indicated at 183 and latches for oven doors 153 and 154 are indicated at 185. Again, it is preferable to utilize electronic, solenoid type latches, although other types of latches could also be utilized. Since such types of latches are widely known in the art and are not considered an aspect of the invention, they will not be discussed further here beyond the details already provided. In a simple form of the invention, punch pad 17 could be utilized to release outer door latches 181 assuming that both the refrigerator door latches 183 and the oven door latches 185 indicate a locked condition and the correct numeric sequence is inputted through punch pad 17. In the alternative, latches 181, 183 and 185 need not have direct sensor input to controller 178, but rather outer door switch 188, refrigerator door switches 142 and 143 and the oven door switches 164 signal controller 78 to permit the opening of door 10 under the desired conditions.

In general, it should be readily apparent that various locking configurations could be utilized to perform the desired function of preventing direct access to the interior of the building 2 upon the opening of door 10. Furthermore, the interior doors 114, 122, 124, 152 and 153 can be readily prevented from opening when exterior door 10 is opened. Although not shown, sensors could even be incorporated within the various compartments of appliance system 28 to sense temperature changes or the like following the opening of door 10 which would indicate the possibility of a person even attempting to access the interior of building 2 through appliance system 28. In any event, there is a preferred interlock between door 10 and doors 122, 124, 152 and 153.

Based on the above, it should be readily apparent that the appliance system 28 of the present invention enables a wide range of perishable items to be delivered. Therefore, the owner of building 2 could order a wide range of food and other items by telephone or through an internet connection from within building 2 or a remote location and have the various products delivered through door 10 to the appropriate compartments of appliance system 2. It could also be possible to remotely control the operational states of one or more of refrigerator unit 31 and oven unit 55 based on the delivery. Utilizing such a control system would enable, for example, upper compartment 58 of oven unit 55 to be programmed to start a heating operation at a preset time such that food placed within oven compartment 58 by a food delivery service could be cooked or maintained hot so as to be ready to serve upon arrival of the owners of building 2. This control system could simply be a timer set by the owners or the delivery personnel, or could be part of an overall computer controlled system for the appliances of system 28 wherein, for example, a main appliance controller (not shown) could be accessed through phone lines or the internet to set the timer from a remote location.

Although described with respect to a preferred embodiment of the invention, it should be apparent that various changes and/or modifications can be made to the invention without departing from the spirit thereof. For instance, heating and cooling functions of appliance system 28 could be performed through the use of a single, thermoelectric unit of the type known in the art to be switchable to perform either heating or cooling functions. In any case, the overall arrangement of the appliance system 28 provides a versatile, product encompassing storage arrangement for consumers which receive products through one or more delivery services. In any event, the invention is only intended to be limited by the scope of the following claims.

I claim:

1. In a building including an exterior wall constituting a side of the building, an appliance system comprising:

an exterior door provided in the exterior wall, said exterior door leading to an interior portion of the building and having an exposed outer surface material which simulates and is substantially flush with an exterior surface material of the exterior wall such that the exterior door blends into and is camouflaged within the side of the building;

a first appliance positioned in the interior portion of the building, said first appliance defining a refrigerator unit including fresh food and freezer compartments both of which are exposable from outside the building upon opening of the exterior door and from inside the building; and a second appliance positioned in the interior portion of the building, said second appliance defining an oven unit including at least one oven compartment which is spaced from the fresh food and freezer compartments and exposable from outside the building upon opening of the exterior door and from inside the building.

2. The appliance system according to claim 1, further comprising: a sub-exterior door extending across the freezer compartment.

3. The appliance system according to claim 1, further comprising: a sub-exterior door extending across at least a portion of the oven unit.

4. The appliance system according to claim 1, wherein said oven unit includes upper and lower oven compartments.

5. The appliance system according to claim 1, further comprising: a cabinet storage zone, separate and distinct from the first and second appliances, which is exposed upon opening of said exterior door.

6. The appliance system according to claim 1, further comprising:

at least one inner door for one of the first and second appliances;

a locking assembly including a first latching unit for locking the inner door in a closed position and a second latching unit for locking the exterior door in a closed position; and means, interconnecting the first and second latching units, for preventing opening of the exterior door when the inner door is open.

7. The appliance system according to claim 6, wherein said preventing means includes an electronic latching assembly.

8. The appliance system according to claim 7, wherein said preventing means includes a controller and means for providing signals indicative of the position of the inner door.

9. The appliance system according to claim 8, wherein said preventing means further comprises:

an outer door switch for signaling the positioning of the exterior door to the controller; and an inner door switch for signaling the position of the inner door to the controller.

10. The appliance system according to claim 8, further comprising:

an electronic punch pad, linked to the controller, for entering an access code to unlock the exterior door.

11. The appliance system according to claim 10, further comprising: a pivotable flap adapted to cover said electronic punch pad, said flap including an outer siding material which simulates an exterior surface material of the exterior wall of the building.

12. In a building including an exterior wall constituting a side of the building, an appliance system comprising:

an exterior door provided in the exterior wall, said exterior door leading to an interior portion of the building, said exterior door has an exposed outer surface material which simulates and is substantially flush with an exterior surface material of the exterior wall such that the exterior door blends into and is camouflaged within the side of the building; and an appliance assembly positioned in the interior portion of the building, said appliance assembly including a refrigerator provided with a fresh food compartment and a freezer compartment, with each of the fresh food and freezer compartments being exposable both from outside the building upon opening of the exterior door and from inside the building.

13. The appliance system according to claim 12, further comprising: a sub-exterior door extending across the freezer compartment.

14. The appliance system according to claim 12, further comprising:

an exposed cabinet storage zone separate and distinct from the appliance assembly, which is exposed upon opening said exterior door.

15. The appliance system according to claim 12, further comprising:

at least one inner door for the appliance assembly;

a locking assembly including a first latching unit for locking the inner door in a closed position and a second latching unit for locking the exterior door in a closed position; and means, interconnecting the first and second latching units, for preventing opening of the exterior door when the inner door is open.

16. The appliance system according to claim 15, wherein said preventing means includes an electronic latching assembly.

17. The appliance system according to claim 16, wherein said preventing means includes a controller and means for providing signals indicative of the position of the inner door.

18. The appliance system according to claim 17, wherein said preventing means further comprises:

an outer door switch for signaling the positioning of the exterior door to the controller; and an inner door switch for signaling the position of the inner door to the controller.

19. The appliance system according to claim 18, further comprising:

an electronic punch pad, linked to the controller, for entering an access code to unlock the exterior door.

20. In a building including an exterior wall constituting a side of the building, an appliance system comprising:

an exterior door provided in the exterior wall, said exterior door opening into an interior portion of the building, said exterior door has an exposed outer surface material which simulates and is substantially flush with an exterior surface material of the exterior wall such that the exterior door blends into and is camouflaged within the side of the building; and a heating appliance assembly positioned in the interior portion of the building, said heating appliance assembly including at least one oven compartment which is exposable both from outside the building upon opening of the exterior door and from inside the building.

21. The appliance system according to claim 20, further comprising: a sub-exterior door extending across a portion of the oven unit.

22. The appliance system according to claim 20, wherein said oven unit includes upper and lower oven compartments.

23. The appliance system according to claim 20, further comprising: an exposed cabinet storage zone separate and distinct from the appliance assembly, which is exposed upon opening of said exterior door.

24. The appliance system according to claim 20, further comprising:

at least one inner door for the appliance assembly;

a locking assembly including a first latching unit for locking the inner door in a closed position and a second latching unit for locking the exterior door in a closed position; and means, interconnecting the first and second latching units, for preventing opening of the exterior door when the inner door is open.

25. The appliance system according to claim 24, wherein said preventing means includes an electronic latching assembly.

26. The appliance system according to claim 25, wherein said preventing means includes a controller and means for providing signals indicative of the position of the inner door.

27. The appliance system according to claim 26, wherein said preventing means further comprises:

an outer door switch for signaling the positioning of the exterior door to the controller; and an inner door switch for signaling the position of the inner door to the controller.

28. The appliance system according to claim 27, further comprising:

an electronic punch pad, linked to the controller, for entering an access code to unlock the exterior door.

* * * * *